US005120087A

United States Patent [19]

Pastva

[11] Patent Number: 5,120,087

[45] Date of Patent: Jun. 9, 1992

[54] BULKHEAD DOOR LOCKING

[75] Inventor: John V. Pastva, Parma, Ohio

[73] Assignee: the Eastern Company, Cleveland, Ohio

[21] Appl. No.: 623,355

[22] Filed: Dec. 7, 1990

[51] Int. Cl.[5] ..... E05C 1/16

[52] U.S. Cl. ..... 292/22; 174/35 GC; 174/35 MS; 292/39; 292/142; 292/160

[58] Field of Search ..... 292/39, 22, 142, 160, 292/172, 279, 280; 174/35 GC, 35 MS

[56] References Cited

U.S. PATENT DOCUMENTS

| | | | |
|---|---|---|---|
| 563,474 | 7/1896 | Cowles | 340/535 |
| 601,948 | 4/1898 | Coons | 292/39 |
| 652,462 | 6/1900 | Kessler | 114/117 |
| 677,868 | 7/1901 | Kessler | 114/117 |
| 829,352 | 8/1906 | Ralston | 114/117 |
| 842,416 | 1/1907 | Nelson | 74/89.17 X |
| 1,416,308 | 5/1922 | Silverman et al. | 292/43 X |
| 1,941,459 | 1/1934 | Bock | 292/142 |
| 2,001,403 | 5/1935 | Williams | 292/45 X |
| 2,140,570 | 12/1938 | Young | 292/341.18 X |
| 2,179,495 | 11/1939 | Court et al. | 292/201 X |
| 2,197,824 | 4/1940 | Young | 114/117 |
| 2,209,060 | 7/1940 | Lambert | 292/45 X |
| 2,315,239 | 3/1943 | Young | 292/341.18 X |
| 2,460,961 | 2/1949 | Wilson | 292/48 |
| 2,488,524 | 11/1949 | Castellano | 292/6 |
| 2,511,268 | 6/1950 | Schiff | 292/48 X |
| 2,879,988 | 3/1959 | Klisch | 292/160 |
| 3,051,280 | 8/1962 | Bergman et al. | 49/249 |
| 3,140,342 | 7/1964 | Ehrreich et al. | 174/35 GC |
| 3,329,106 | 7/1967 | Lingal | 109/75 |
| 3,758,919 | 9/1973 | Dilworth, Jr. | 292/250 X |
| 3,783,173 | 1/1974 | Twomey | 174/35 GC |
| 3,791,073 | 2/1974 | Baker | 49/249 |
| 4,114,424 | 9/1978 | Johnson | 220/232 X |
| 4,180,943 | 1/1980 | Smith et al. | 49/279 |
| 4,434,541 | 3/1984 | Powers, Jr. | 174/35 GC |

FOREIGN PATENT DOCUMENTS

| | | | |
|---|---|---|---|
| 0330807 | 9/1989 | European Pat. Off. | 292/218 |
| 2199362 | 7/1988 | United Kingdom | 292/321 |

*Primary Examiner*—Renee S. Luebke
*Assistant Examiner*—Darnell M. Boucher
*Attorney, Agent, or Firm*—Watts, Hoffmann Fisher & Heinke

[57] ABSTRACT

An apparatus and method is disclosed for selectively locking and unlocking a large, heavy bulkhead door at several points about its periphery. A plurality of locking fingers are slidably mounted on the door for selective extension and retraction with respect to the door edges. A handle mounted on the door provided for rotational movement of a handle shaft. A double rack and pinion linkage responds to rotational movement of the handle shaft to cause a pair of drive rods to move axially and linearly outwardly and inwardly from the handle shaft. A pair of shaft drive assemblies, including second rack and pinion structures, causes axial rotation of two substantially vertical drive shafts extending along the door edges. A plurality of finger drive assemblies is coupled, by third rack and pinion structures, to extend and retract the locking fingers in unison in response to rotation of the drive shafts. The door itself is suspended on a plurality of special lost motion floating hinges to enable it to seat evenly in a casing defining the opening the door is to cover, in order to establish a uniform seal force about the periphery of the door and the inside edge of the casing. The locking fingers each have an inclined portion to facilitate a ramped engagement with the casing to increase the sealing force as the fingers are progressively extended. A detent structure associated with each finger holds the fingers in locked position until release and door opening is desired. A silver-impregnated elastomeric resilient door sealing member is provided.

8 Claims, 9 Drawing Sheets

BULKHEAD DOOR LOCKING

FIELD OF THE INVENTION

The present invention relates generally to apparatus and method for locking heavy bulkhead doors designed to block passage of electromagnetic radiation. The invention relates more particularly to specific novel apparatus for securing the door to a surrounding casing at a number of points about its periphery and to hinging apparatus for facilitating closure and locking of the door to provide a tight and uniform seal between the door and its surrounding casing.

BACKGROUND ART

Sophisticated electronic gear, such as computers and communication equipment, requires highly effective shielding from various types of electromagnetic radiation. Electromagnetic radiation which can interfere with the operation of such equipment, or damage it, includes radio frequency interference (RFI), electromagnetic interference (EMI) and even ultraviolet. Another type of damaging electromagnetic phenomena is the so-called electromagnetic pulse, or EMP. This is a very damaging form of electromagnetic radiation which occurs in the immediate aftermath of a nuclear explosion. Protection from EMP is of particular interest in military applications.

Stationary and mobile guided missile installations, for example, require a great deal of computer and electronic communications equipment. Such equipment has been mounted on large vehicular trailers which carry bulkheads, a roof, and other structure for forming a closed operations chamber or room. It is necessary that such operations rooms be heavily shielded from radiation of the types discussed above.

These mobile operations rooms obviously must be provided with access doors. Such doors must also be heavily shielded, to block out undesirable electromagnetic radiation. Doors made of radiation-impervious materials, such as heavy steel and lead, are commonly used. These doors are hung, from a casing surrounding the door opening, on heavy hinges. The door is pivoted about a substantially vertical axis near one of its vertical edges.

Bulkhead doors are also employed in ships, airplanes and railroad trains. In some of these applications, such doors must provide the shielding explained above.

Such bulkhead doors must not leak appreciable radiation around their edges or elsewhere. If a good seal is not effected, leakage will result. Leakage will also result if the heavy door does not close straight into its opening, but rather becomes wedged at a slight angle.

Problems have also arisen from leakage through resilient sealing members which are employed to assist in providing an airtight seal around the doors. Such seating members are elastomeric and radiation pervious.

Since such bulkhead doors are often very large and heavy, it is desirable that locking mechanisms employed with the doors be simple and reliable in operation, and that they can be operated between locked and unlocked states by a single operator. It is also desirable that the locking mechanism provide for securing the door at multiple locations about its periphery, to enhance the uniformity and tightness of the seal.

Openings in the door surface provided for accepting handles have also caused leakage problems.

In some of the prior art bulkhead doors, the operator must provide a strong push on the door at the same time that he actuates the locking mechanism. This is necessary to move the door into its casing to some degree against the resilient sealing members before the door can be locked.

It is an object of the present invention to provide apparatus and method for easily locking a large radiation impervious bulkhead door against electromagnetic radiation, and for providing a uniform seal about the entire periphery of the door, without the need for large operator force being applied to compress the door seal.

DESCRIPTION OF THE INVENTION

The disadvantages of the prior art are reduced or eliminated by an apparatus for locking a door including one or more locking fingers slidably mounted on the door for extension into engagement with a door casing. The apparatus includes a handle for producing rotative motion of a first mechanical component about a first axis which is substantially normal to a major face of the door. Apparatus converts this rotative motion to linear motion of a second mechanical component in a direction parallel to the major face of the door. Further apparatus converts the linear motion to rotational motion of a third mechanical component about a second rotational axis normal to the second components' direction of linear motion and also parallel to the major face of the door. Still other apparatus convert this final rotational motion to extension of the door locking fingers.

This unique combination of mechanical motion-converting apparatus affords an easy locking mechanism for the door which can extend several locking fingers simultaneously, at multiple points around the door, when an operator simply moves a handle.

In accordance with a more specific aspect of the invention, the motion converting apparatus includes one or more rack and pinion assemblies.

According to another aspect, a particular type of lost motion door hinge is provided for facilitating the door settling evenly into its casing and for a uniform distribution of force application between door and casing about the entire periphery of the door. The hinge has the door mounted on a floating bracket which is pivotally attached to the hinge strap for rotation about a vertical axis which is transversely displaced from the main axis of rotation between the hinge strap and the hinge butt.

According to another specific feature, electromagnetic leakage around the edge of the door and around openings in the door is inhibited by the use of silver-impregnated elastomeric O-ring seals which are substantially impervious to electromagnetic radiation.

Another specific feature involves providing the locking fingers with inclined portions for ramping engagement with the casing, and with detent structure for holding the fingers in locked position until release is desired.

The specific details of the present invention will be better understood by reference to the following specific description, and to the drawings, in which:

DETAILED DESCRIPTION OF THE DRAWINGS

Figure 1:
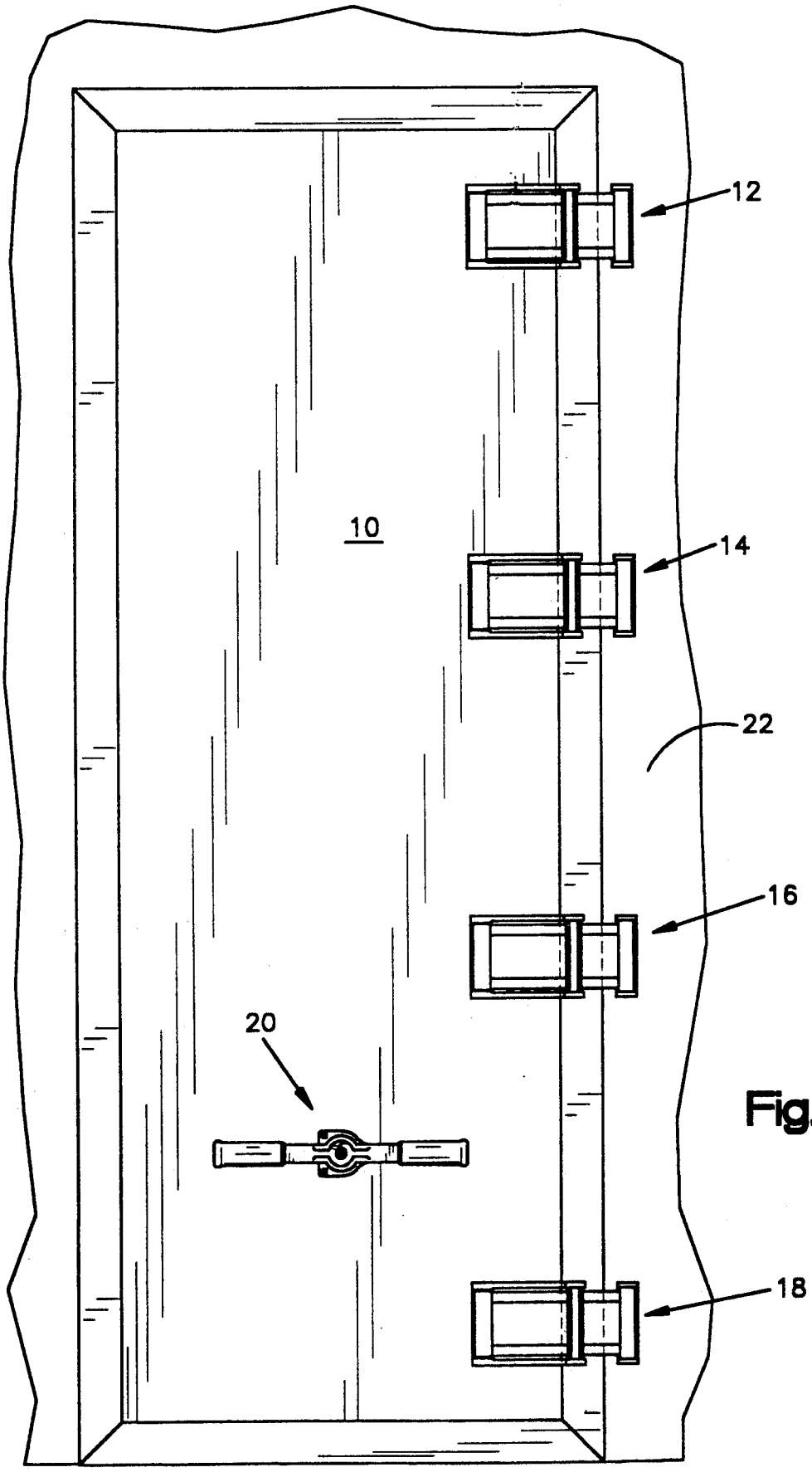
FIG. 1 is an elevational view of the outside of a door embodying the present invention.

FIG. 1 illustrates a bulkhead door 10 for mounting in a casing 22 of a large container, or room, for housing sophisticated electronic equipment. The door 10 is made of a heavy ferromagnetic material, such as steel. One of the prerequisites of the door 10 is that it be impervious to electromagnetic radiation.

FIG. 1 also illustrates four hinge assemblies 12, 14, 16 and 18 for use in mounting the door 10 to a casing.

FIG. 1 also shows an outside door handle 20 for actuating a locking mechanism of the present invention in a manner described in more detail below.

The door 10 is large enough to permit a human of normal size to pass through, and is hinged at its right hand side for pivotal motion about a vertical axis as viewed in FIG. 1, located near its right hand side. The door swings outwardly, i.e., toward the viewer of FIG. 1.

The hinges 12, 14, 16, 18 are of a special type, and they are described in more detail below, particularly in connection with FIGS. 7–10.

Figure 2:
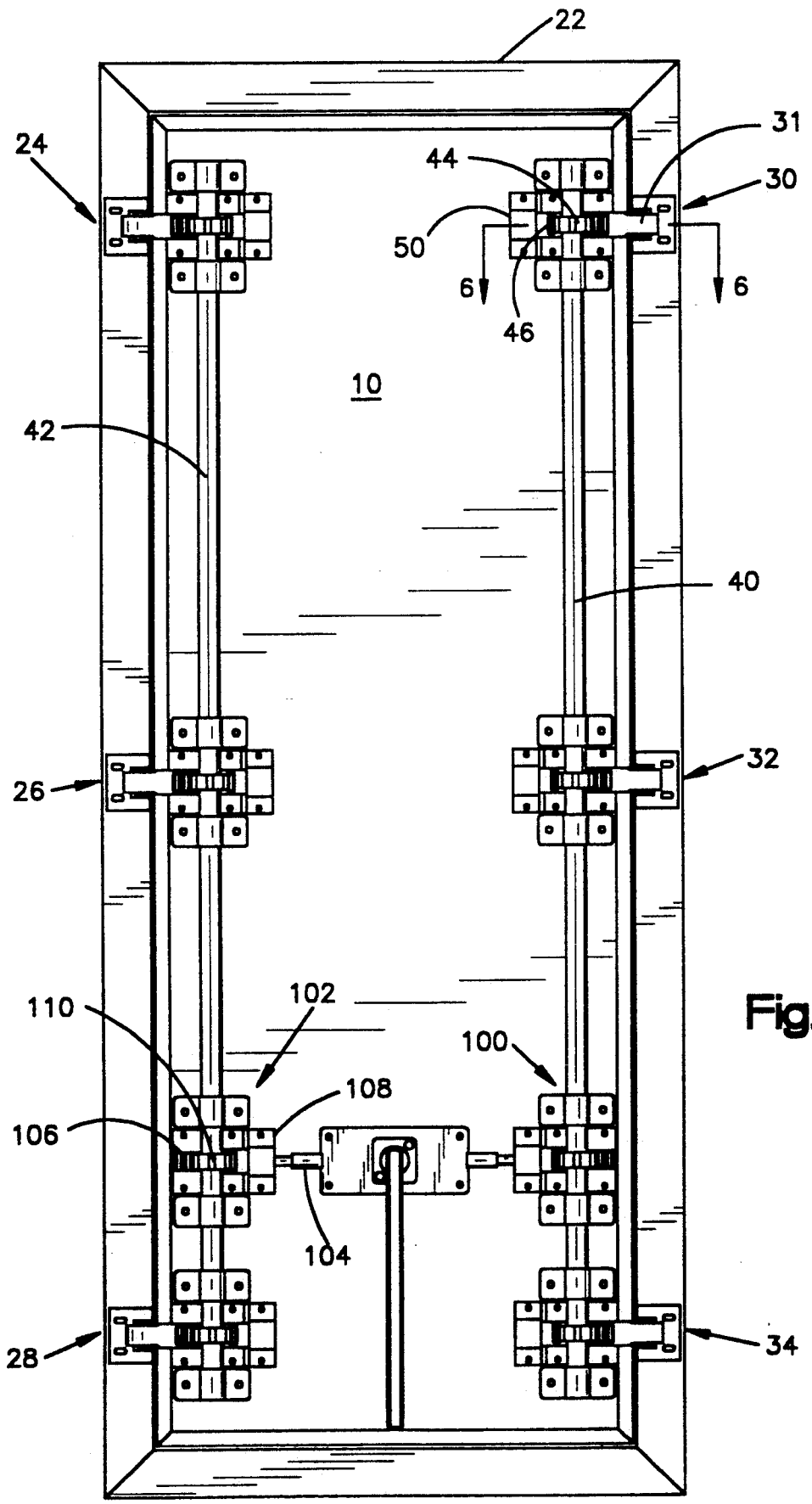
FIG. 2 is an elevational view of the inside of the door of FIG. 1.

FIG. 2 illustrates the inside of the door 10, and reveals several aspects of a door locking system which embodies the present invention. FIG. 2 also illustrates the casing 22 which surrounds the opening to be secured by the door 10.

The door locking apparatus illustrated in FIG. 2 is a six point locking system, and secures the door 10 in place by engagement of retractable fingers with the casing at six locations about the periphery of the door 10. The six fingers are reciprocally extendable by actuation of six respectively associated finger drive assemblies. The finger drive assemblies are generally designated in FIG. 2 by reference characters 24, 26, 28, 30, 32 and 34.

The finger drive assemblies are driven in unison, or ganged fashion, in two sets of three each. More specifically, the three finger assemblies 30, 32, 34 are driven in unison by rotation of a longitudinal drive shaft 40. The finger drive assemblies 24, 26, 28 are driven in unison by rotation of another longitudinal drive shaft 42. Both drive shafts 40 and 42 are rotated in unison by other mechanism described in more detail below.

The finger drive assemblies are substantially identical to one another in structure and operation. As such, only one of the finger drive assemblies will be described in detail, i.e., finger drive assembly 30. located in the upper right portion of FIG. 2. In describing the finger drive assembly, reference will also be made to FIGS. 5, 6 and 6a. The finger associated with the assembly 30 is designated as 31.

The finger drive assembly 30 operates by rotation of a pinion 44 which is rotationally fixed to the drive shaft 40. See FIGS. 2, 5, 6 and 6a.

The pinion 44 is engaged with a rack 46 which is supported, for linear reciprocal movement right and left, as seen in FIG. 2, by a slide block 48 which is affixed to the inside of the door 10 by a bracket 50. The bracket 50 also carries bearings, such as 56, 58 in FIG. 5, for supporting the longitudinal drive shaft 40 for axial rotative motion.

Figure 5:
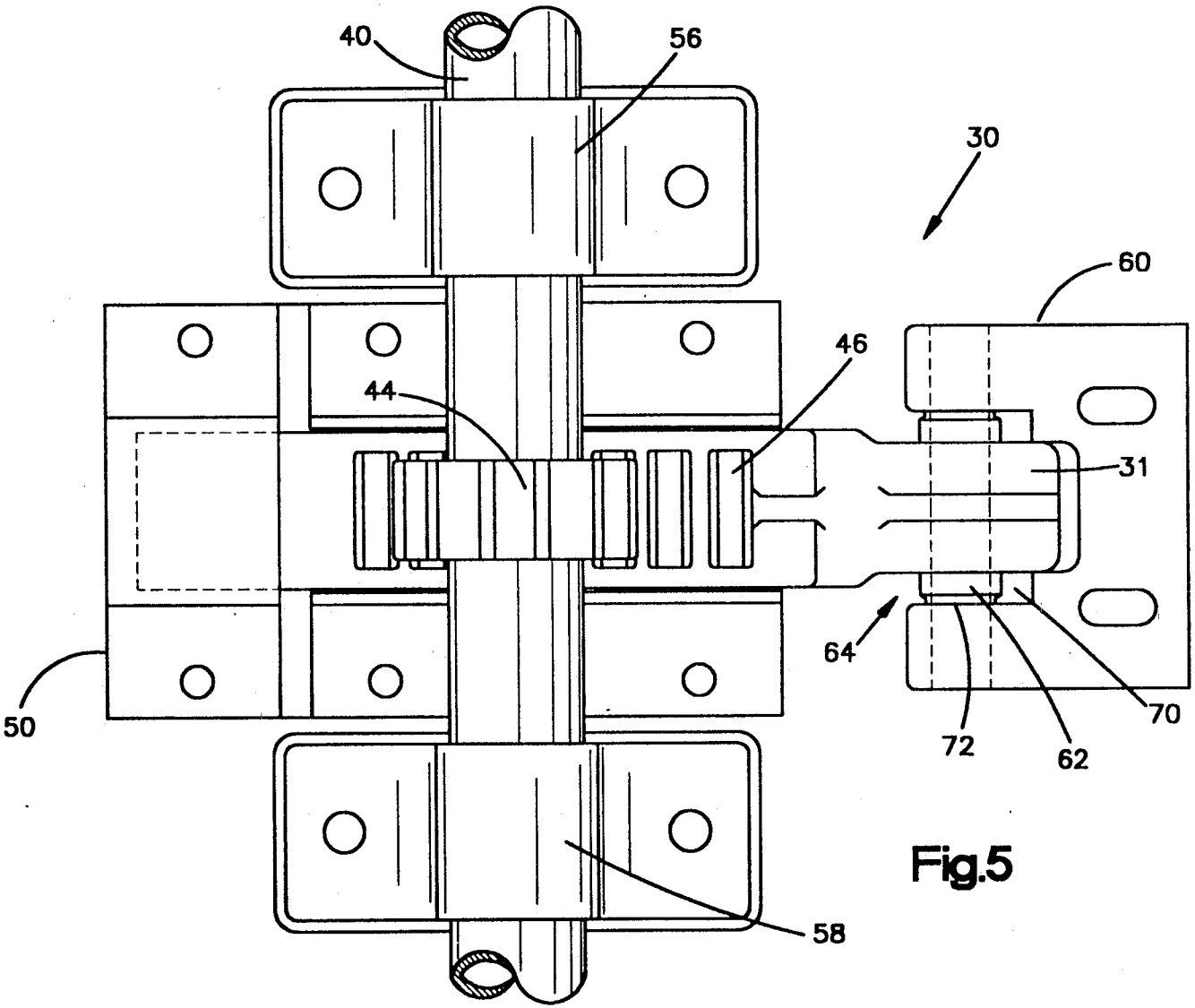
FIG. 5 is a sectional view illustrating a detail of an embodiment of the invention as shown in FIG. 1.

FIG. 5 also illustrates a finger engagement bracket 60 mounted on the inside of the casing 22 and aligned with the finger drive assembly 30 to engage the locking finger when extended by actuation of the finger drive assembly 30. The bracket 60 defines a vertical protruding roller pin 62, shown in FIG. 5 and in FIGS. 6 and 6a.

Figure 6:
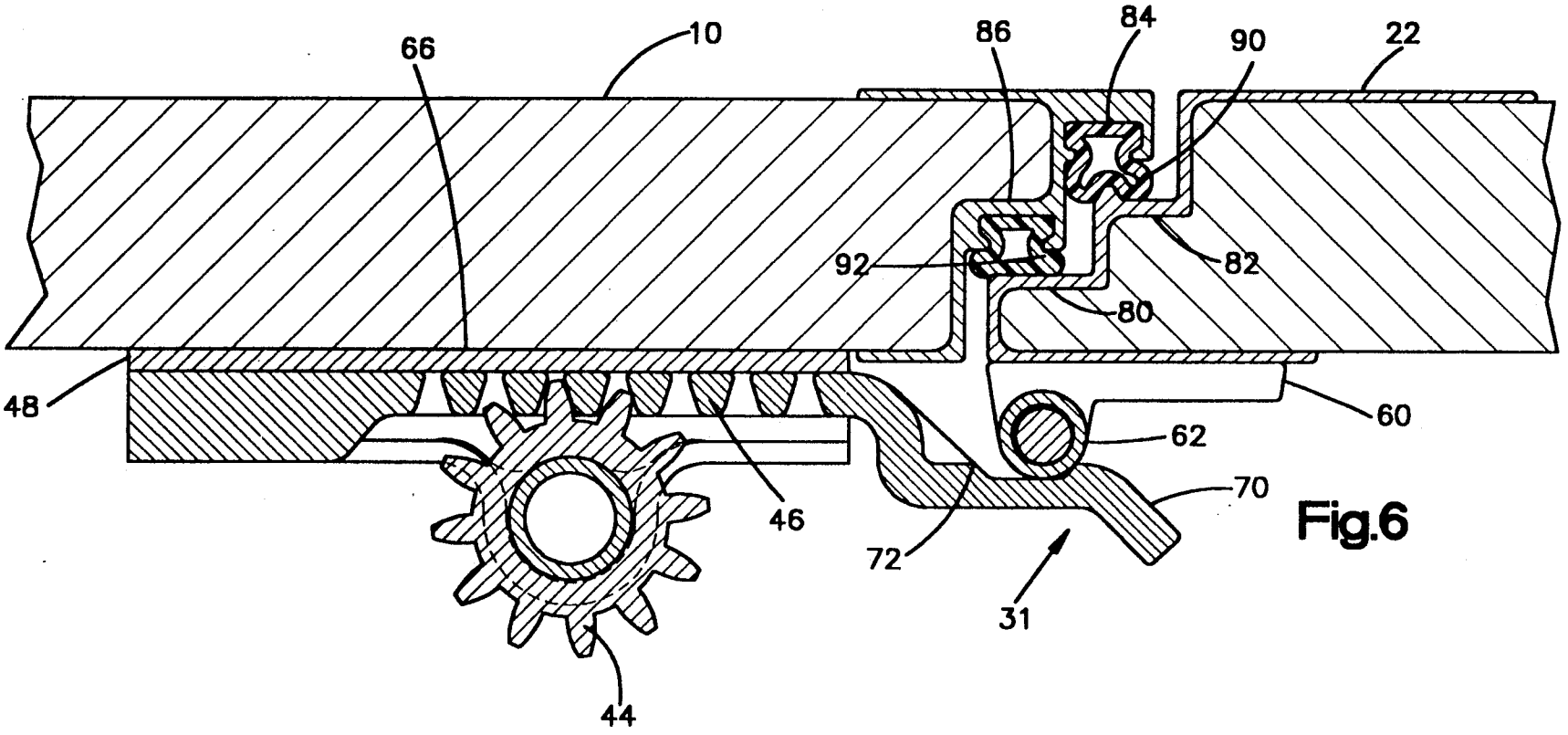
FIG. 6 and 6a are sectional views of a portion of door in FIG. 2, taken along the lines 6—6 of FIG. 2.
Figure 6A:
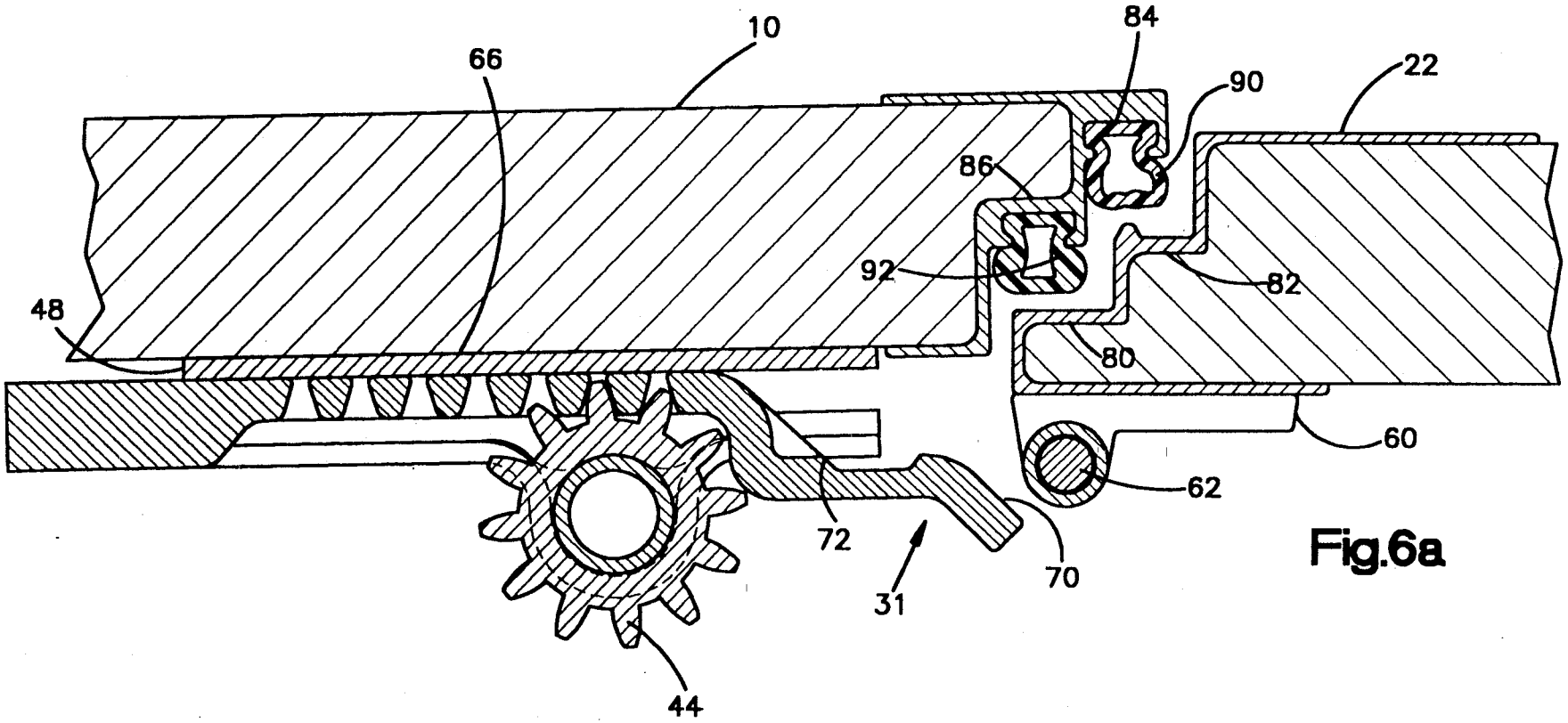

Operation of the finger drive assembly is most clearly shown in FIGS. 6 and 6a. FIG. 6 is a sectional view taken from above the finger drive assembly. The locking finger is designated by reference character 31, and is in fact an integral extension of the rack 46. The finger portion 31 and the integrally formed rack 46 are supported in known fashion, for linear movement to the right and left as shown in FIG. 6, by the slide block 48, referred to above, which is affixed to the inside surface 66 of the door 10. When the pinion 44 is rotated in a clockwise direction by axial rotation of the drive shaft 40, the integrally formed rack 46 and finger 31 moves to the right (FIG. 6). When the pinion is rotated in a counterclockwise direction, the rack and finger move to the left (FIG. 6a).

The locking finger 31 defines an inclined ramp portion 70, and a recessed portion 72. The inclined portion 70 facilitates gradual, ramped engagement of the finger 31 with the roller pin 62 which is defined by the bracket 60. This structure enables progressively forceful engagement of the door 10 with the casing 22 as the finger 31 advances to the right and first encounters the roller pin 62.

The range of motion of the integrally formed rack and locking finger extends from a location at which the inclined portion 70 is to the left of the roller pin 62, as shown in FIG. 6a, to a limit of rightward motion which is illustrated by the relative position of the elements as shown in FIG. 6.

The door 10 engages the casing 22 in a resilient fashion. The casing 22 defines stepped portions 80, 82, which are in general registration with similar stepped portions 84, 86 defined on the outward periphery of the door 10 and illustrated in cross section in FIGS. 6 and 6a. Between the mating step portions 82, 84 is a resilient sealing member 90, shown in cross section in FIG. 6. The sealing member 90 is a hollow O-ring made of a resilient substance such as rubber, impregnated with silver. A similar resilient sealing member 92 is located between the stepped portions 80, 86 of the casing and door, respectively. Each of the sealing members 90, 92 is preferably attached, such as by adhesive, to one of its adjacent stepped portions.

The resilient sealing of the door against the casing enables the inclined portion 70 to work against the resilient seal to draw the door 10 against the casing 22 gradually, as a function of the degree of rightward motion of the inclined portion 70 as it encounters the lip 62. As the finger and its inclined portion 70 is moved to the right, the resiliency of the seal between door and casing permits the lip 62 to ride up and over a crest of the inclined portion 70, such that the roller pin 62 comes to rest in the recessed portion 72 of the finger. Thus, the roller pin 62 and recessed portion 72 of the finger coact to provide a detent for inhibiting inadvertent leftward motion of the finger 31 after the finger has been latched with the roller pin 62 to provide a latching seal of the door 10 to the casing 22.

Referring once again to FIG. 2, the longitudinal rods 40, 42, are rotated by actuation of rod drive assemblies 100, 102, respectively. The rod drive assemblies 100, 102 are substantially identical in construction, and only the rod drive assembly 102 will be described in detail.

The rod drive assembly 102 converts linear axial motion of a drive rod 104 to rotational motion of the longitudinal drive shaft 42.

The rod 104 is coupled to a rack 106 which is mounted for right and left hand sliding motion by a bracket 108 which is itself affixed to the inner surface of the door 10. Right and left hand motion of the rack 106 rotates a pinion gear 110 which is rotatably fixed to the shaft 42.

Thus, right and left hand motion of the rod 104 results in rotative motion of the drive shaft 42, which in turn actuates operation of the left hand set of three finger drive assemblies, to extend or retract the fingers, depending on the direction of motion of the rod 104.

The linear axial motion of the drive rods 104, 105 is provided in response to rotative manual movement of the outside door handle 20 and a drive rod linkage coupling the handle with the drive rods. The handle and drive rod linkage are illustrated in detail in FIGS. 3, 4, 11 and 12.

Figure 3:
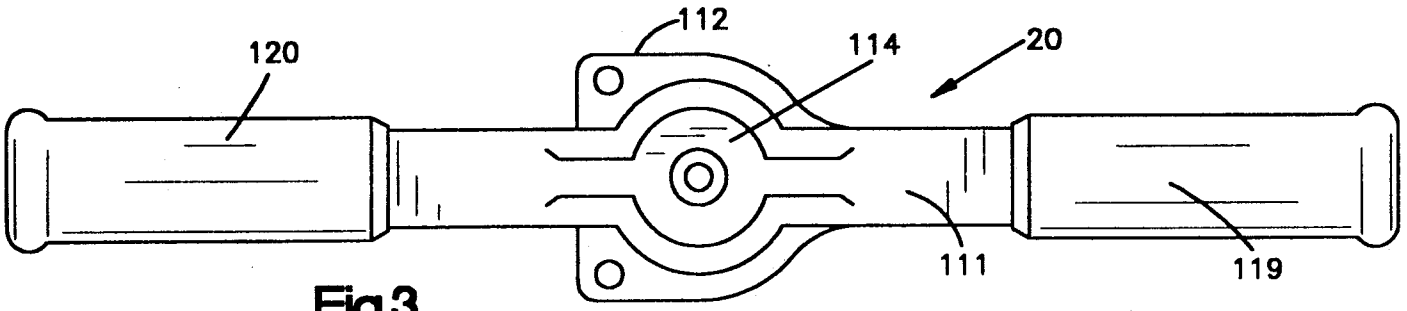
FIG. 3 is a detailed view of an outside door handle illustrated in FIG. 1.

FIG. 3 is simply an elevational view of the handle 20 and shows a bracket 112 for securing the handle to the outside of the door 10, a hub portion generally indicated as 114, and two diametrically opposed arm portions 116, 118. On the end of each arm portion 116, 118, are mounted grip portions 119, 120, respectively.

Figure 4:
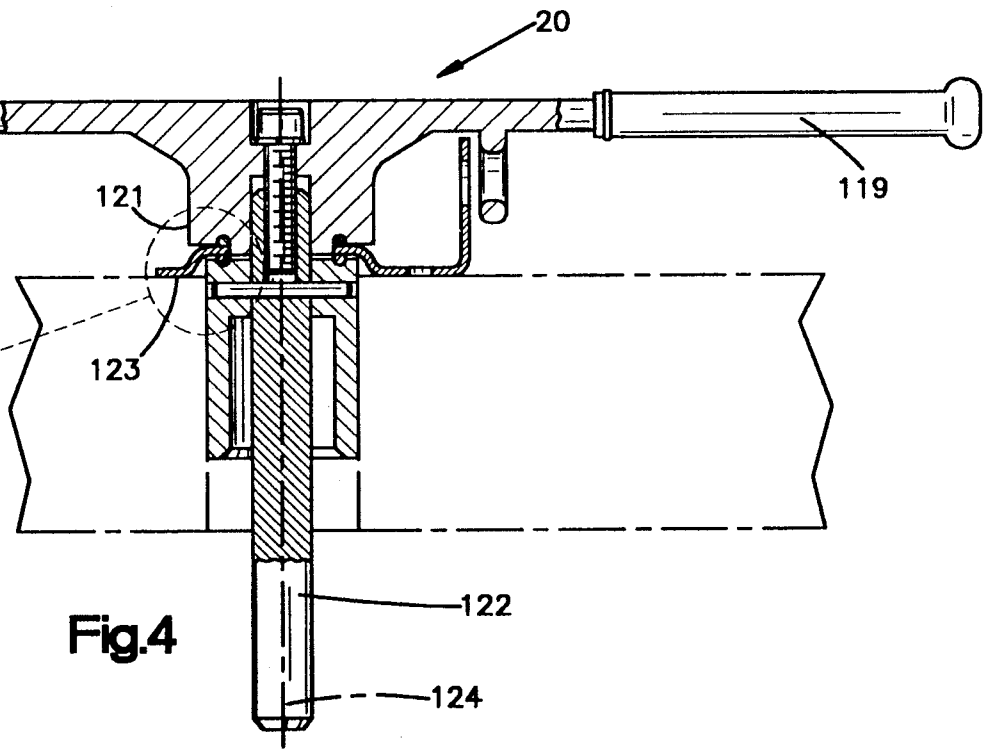
FIGS. 4 and 4a are sectional views illustrating the handle of FIG. 3 and associated mechanical structure actuated by the handle.

FIG. 4 illustrates a top view of the handle 20, partly in cross section, and certain components associated with the handle 20 and its mounting with respect to the door 10. Briefly, the structure indicated in FIG. 4 provides for rotative movement of a handle shaft 122, about a pivot axis 124, in response to manually driven rotative movement of the handle 20.

Figure 4A:
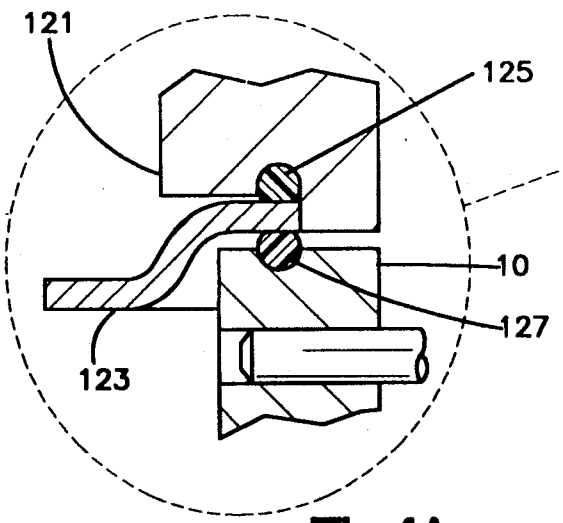

FIG. 4*a* illustrates by an enlarged circular inset a feature of FIG. 4 of particular interest. FIG. 4*a* shows a portion of a central base of the handle 20, the portion being designated by the reference character 121 in FIGS. 4 and 4*a*. FIGS. 4 and 4*a* also illustrate a shield member 123 which is adapted to hold the handle 20 in position against the outside surface of the door 10. The central base portion 121 of the handle 20 is rotatably movable relative to the shield portion 123.

Two O-rings 125, 127 are illustrated in cross-section in FIGS. 4 and 4*a*. The O-ring 125 is located between the central base portion 121 of the handle 20 and the shield member 123. The O-ring 127 is located between the shield 123 and the surface of the door 10. The O-rings 125, 127 are made of an elastomeric material which is impregnated with an electrically conductive material. The conductive material is metal, preferably silver.

So impregnated, the O-rings 125, 127 enhance the sealing between the handle 20 and the door 10. The seal is both mechanical and also to inhibit leakage of electromagnetic radiation through the space between the mechanism linking the handle 20 to the door 10. Thus, the opening provided for the handle 10 need not leak appreciable electromagnetic radiation.

Figure 11:
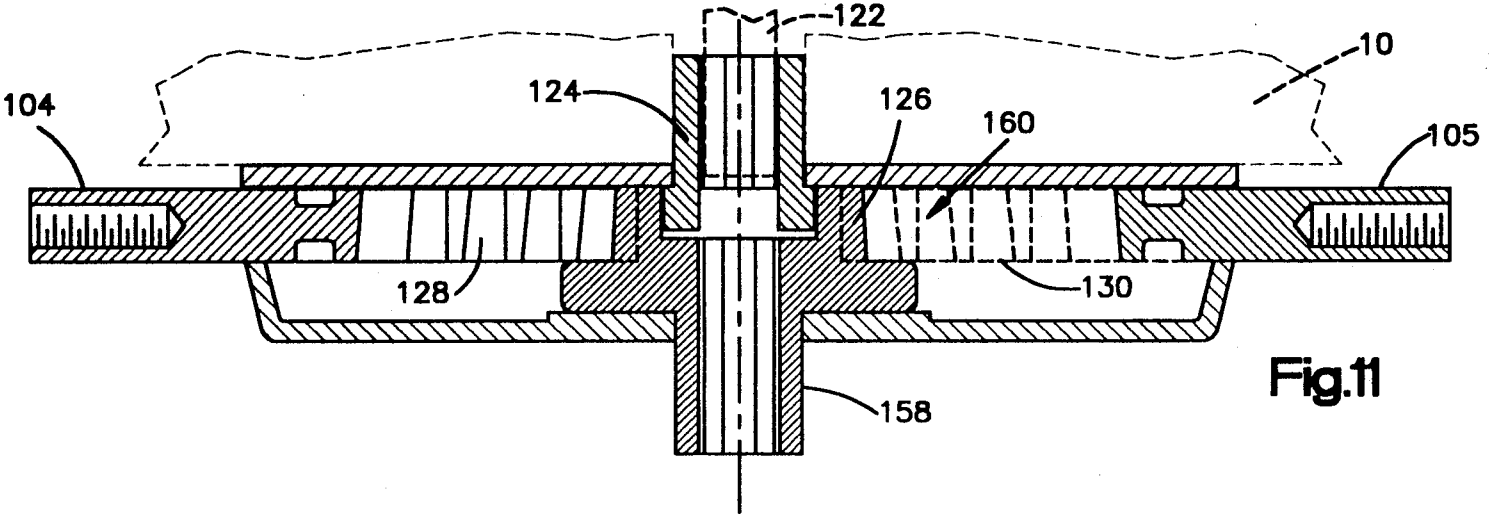
FIG. 11 is a sectional view, partly in cross-section, showing a portion of mechanism illustrated in FIG. 2.

FIG. 11 illustrates mechanism and operation of the drive rod linkage assembly. FIG. 11 illustrates the position of the shaft 122. The shaft 122 is inserted into and spliced with a drive tube 124. When the shaft 122 is rotated axially, so also is the drive tube 124.

The drive tube 124 is connected to a pinion gear 126 which is rotationally fixed to the drive tube 124, and therefore rotates with it.

The pinion gear 126 is engaged with two racks. More specifically, the pinion gear 126 is engaged with a lower rack 128 and an upper rack 130. The rack 128 is shown with its teeth facing upwardly, while the rack 130, with teeth facing downwardly, shows the teeth only with hidden lines.

The rack 128 is fixedly attached to drive the drive rod 104 to the right and left, as illustrated in FIG. 11. The rack 130 is similarly connected to drive the rod 105 along a parallel direction. When the pinion gear 126 is driven in one direction, both racks 128, 130 cause their respectively attached drive rods to extend outwardly away from the drive tube 124. When the pinion is rotated in the opposite direction, both racks cause their respective drive rods to retract toward the center of the view as expressed in FIG. 11.

Accordingly, when the handle 20 is rotated in one direction, that rotative motion is converted to linear axial motion of the drive rods 104, 105. The motion of the drive rods 104, 105 is in a direction substantially perpendicular to the axis of the shaft 122 (which is perpendicular to the outside face of the door) and is also in a direction substantially parallel with the door's outside face.

Linear axial motion of the drive rods is converted by the shaft drive assemblies 100, 102, to axial rotational motion of the drive shafts 40, 42. The axis of this rotational motion is substantially perpendicular to the direction of linear motion of the drive rods 104, 105 and is also substantially parallel with the outside face of the door 10.

The axial rotative motion of the drive shafts 40, 42 is then converted to linear motion of the locking fingers by the finger drive assemblies, such as at reference character 30, which are six in number, spaced three on each side of the door 10. The directional movement of the fingers is substantially perpendicular to the axis of rotational axial motion of the shafts 40, 42, and is also substantially parallel to the outside face of the door 10.

It can be seen that manual rotation of the handle 20 in one direction causes all six of the locking fingers to extend outwardly from the periphery of the door in unison, or in ganged, fashion. Rotation of the handle 20 in the opposite direction causes the ganged retraction of the locking fingers, and releases the door.

Figure 12:
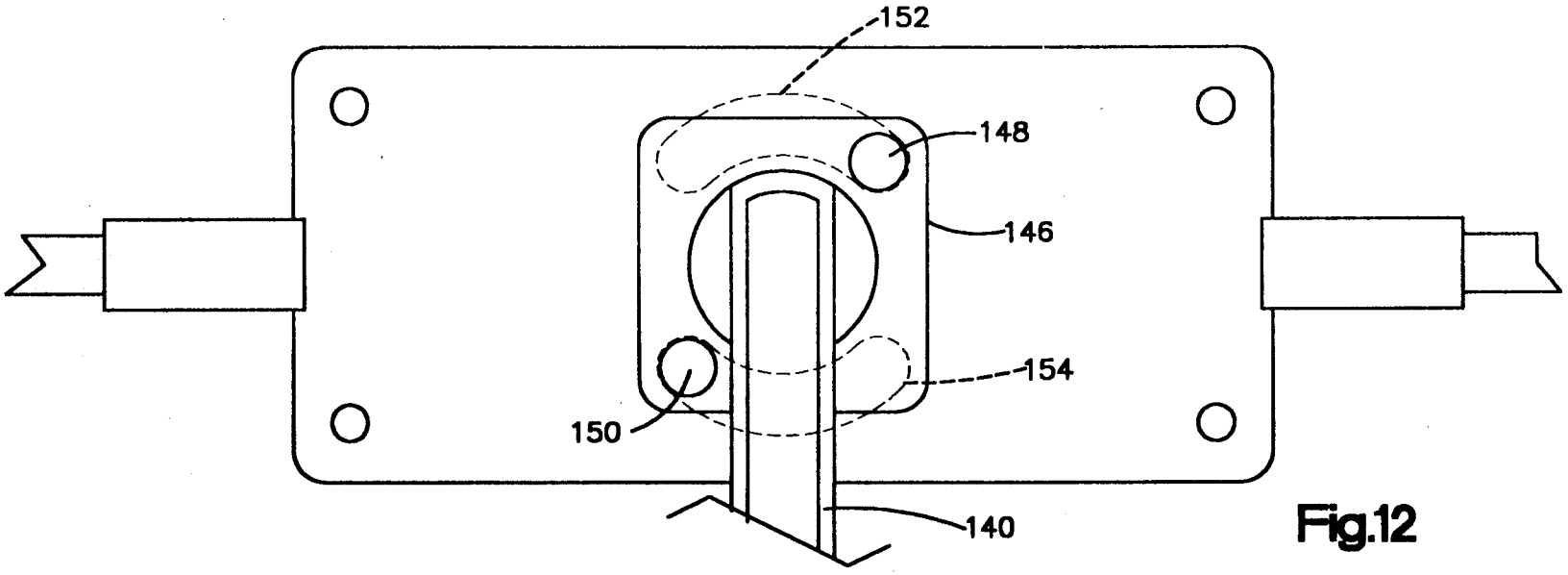
FIG. 12 is a sectional view of a portion of mechanism shown in FIG. 2.

The door locking mechanism described above is also actuable from inside the door, by means of an inside door handle 140, illustrated in FIGS. 2 and 12. Referring to FIG. 2, the door handle 140 is attached to the inside face of the door 10 and is rotatable in the directions indicated by a double headed arrow 142.

Referring to FIG. 12, the handle 140 is interfaced to the inside face of the door 10 by means of a bracket 146.

A pair of roller pins 148, 150 are confined in curved slots 152, 154, respectively, shown in dotted lines in FIG. 12. The roller pins 148, 150 limit the amount of rotational motion of the handle 140 to approximately ¼ of a turn.

Referring back to FIG. 11, the handle 140 is coupled to a tubular hub 158 of the pinion gear 126, such that the pinion gear is rotationally fixed with respect to the handle 140. When the handle 140 is rotated, the pinion gear 126, the drive tube 124, and the outside handle 20 all rotate in unison.

The hinge structure is illustrated in detail in FIGS. 7–10. Since the hinges 12, 14, 16, 18, as illustrated in FIG. 1, are substantially identical in construction and operation, only the hinge 12 will be described in detail.

The hinge 12 is a type of lost motion, or "floating" hinge which affords the door 10 a small amount of rotational freedom of movement, or "play" about a vertical axis, which axis is displaced from the vertical axis defining the door's main pivoting motion between generally open and generally closed positions.

FIGS. 7–10 are detailed illustrations of the hinge 12 as viewed from above in FIG. 1. The hinge 12 includes a hinge butt portion 200 coupled to a hinge strap portion 202. The hinge strap 202 is mounted by a pin 203 for pivotal motion with respect to the hinge butt about a pivot axis 204. The hinge butt 200 is affixed to the door casing 22.

A floating support bracket 206 is mounted by a pin 207 for pivotal motion with respect to the hinge strap 202, about a pivot axis 208. The bracket 206 is attached to the outer surface of the door 10 along a surface indicated by reference character 210. Both the door 10 and the casing 22 are illustrated in phantom in FIGS. 7–10.

The bracket 206 defines an ear portion 212 on which is mounted a stop member 214 which comprises a short rod or pin.

Figure 9:
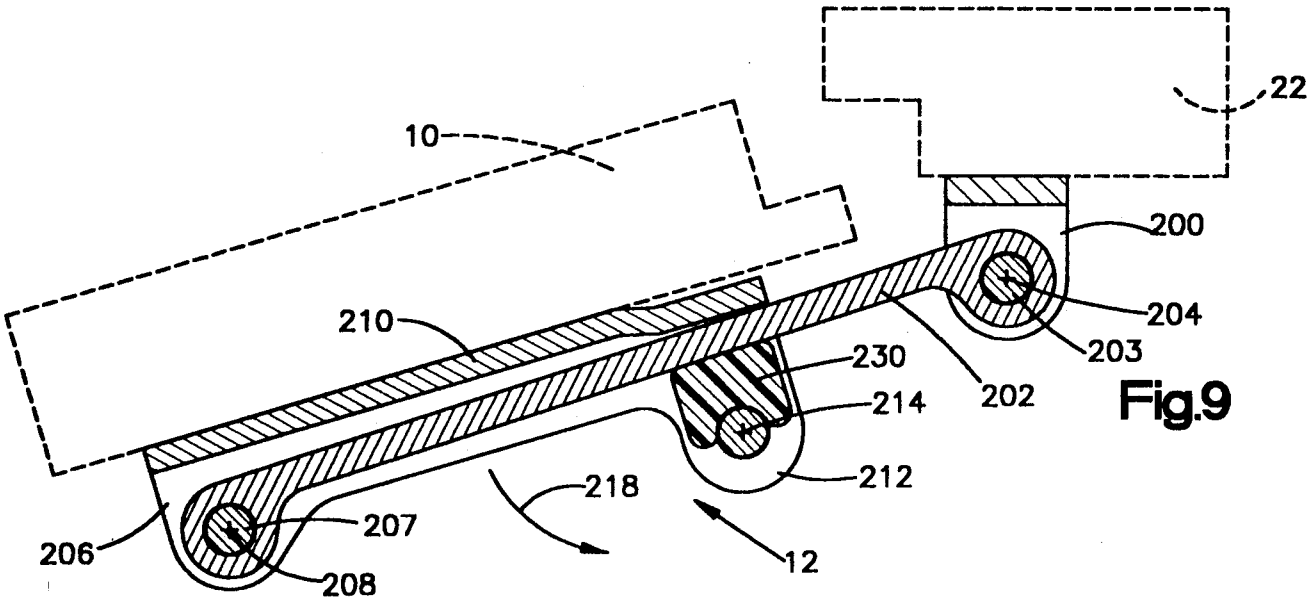
FIG. 9 is a sectional view of the hinge of FIG. 7, but showing the hinge in a different position of its range of motion.
Figure 10:
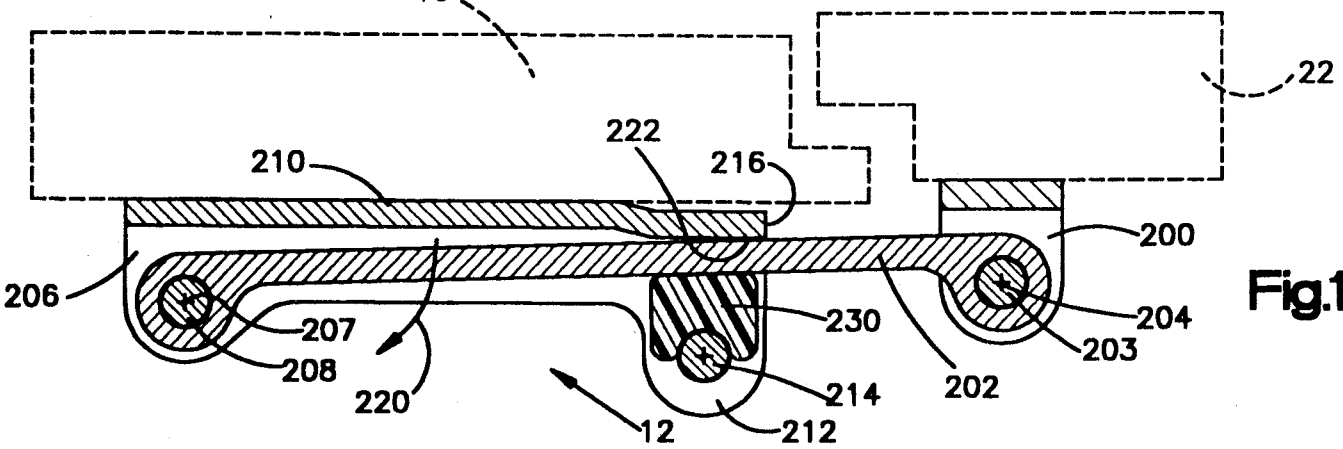
FIG. 10 is a sectional view of the hinge of FIG. 7, but showing the hinge in another position of its range of motion.

Operation of the hinge is illustrated in FIGS. 9 and 10. In FIG. 9, the hinge is illustrated as providing for the main pivoting motion of the door about the pivot axis 204. In FIG. 9, the door has opened through a rotational displacement illustrated by an arrow 218.

FIG. 10 illustrates an additional degree of rotational freedom provided by the hinge 12. As shown in FIG. 10, the door 10 has rotated a few degrees counterclockwise about the pivot axis 208. The direction of this motion is illustrated by an arrow 220 in FIG. 10.

A limit of counterclockwise motion is defined by a slightly offset portion 216 of the floating support bracket 206. In FIG. 10, the offset portion 216 can be seen to have contacted the bottom surface of the hinge strap 202 at a location indicated by the reference character 222.

It can be seen from FIGS. 9 and 10 that a limit of clockwise rotation of the door 10 about the pivot axis 208 is defined by the stop member 212 described above.

The hinge also includes a resilient cushion or bumper member 230. As illustrated in FIGS. 1 and 7–10, the bumper member 230 is interposed between the stop pin member 214 and the hinge strap 202.

Figure 7:
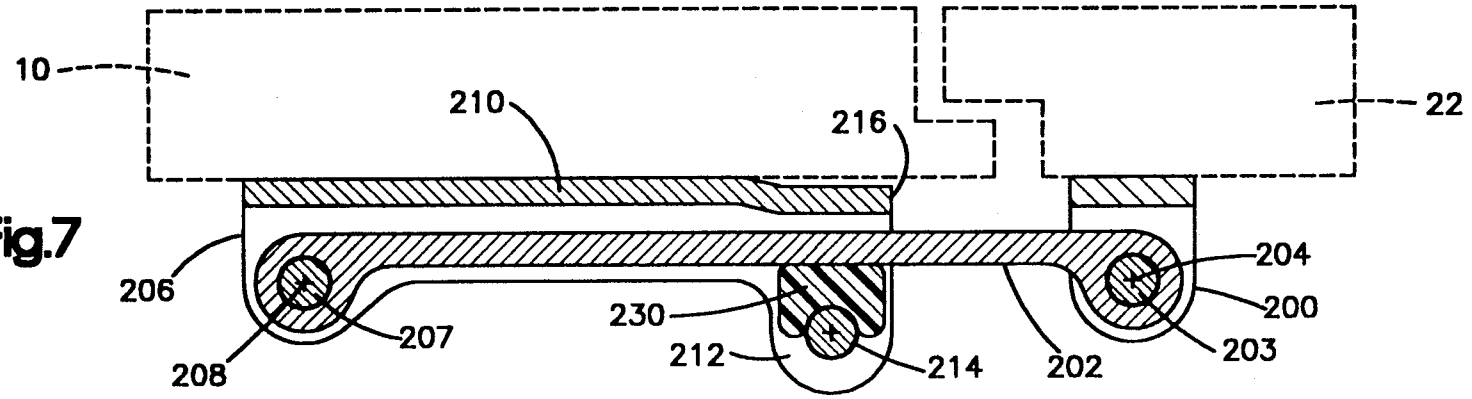
FIG. 7 is a detailed sectional view of a door hinge illustrated in FIG. 1.
Figure 8:
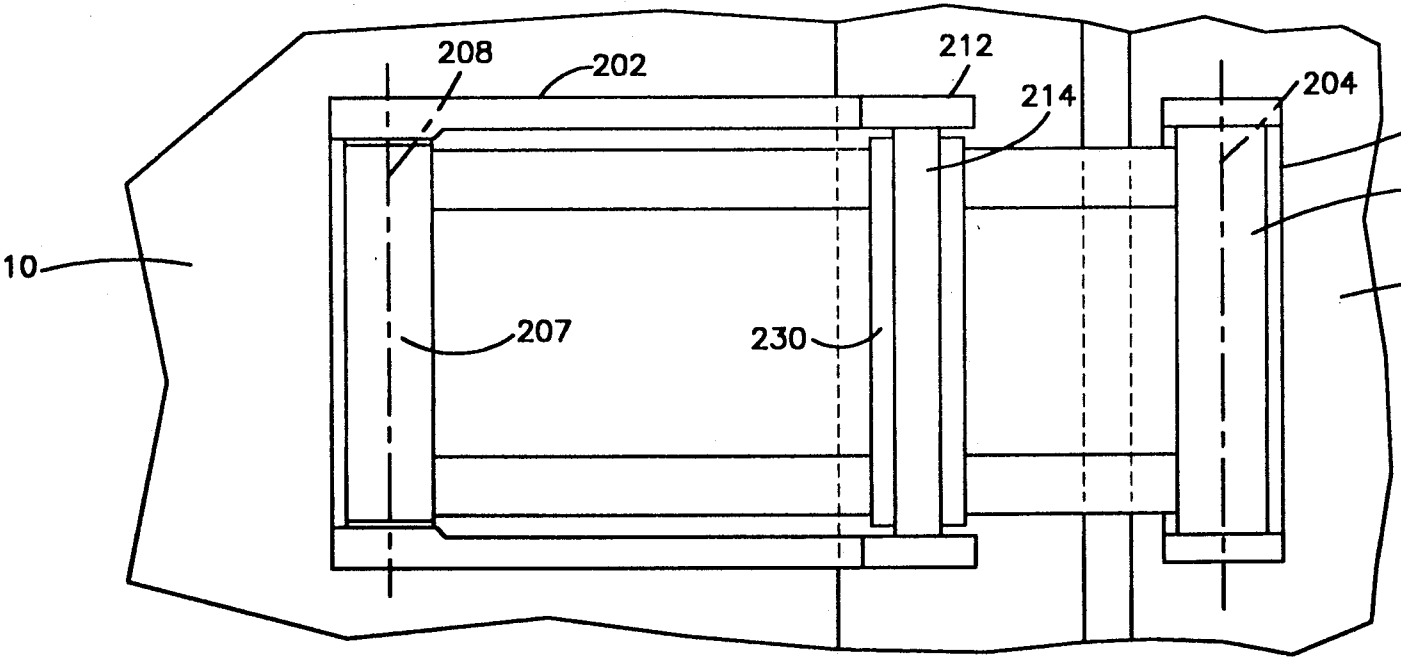
FIG. 8 is a detail view of the hinge shown in FIG. 7.

The resilient bumper member 230 is under compression between the stop pin member 214 and the hinge strap 202. This compressed interposition of the bumper member urges the floating bracket 210 for rotation in a clockwise direction about the axis 208, as illustrated in FIGS. 7, 9 and 10.

Then the door 10 is open, as in FIG. 9, the bumper member 230 is under only slight compression. When, however, the door 10 is in a closed position, such as illustrated in FIG. 10, the bumper member 230 is under higher compression than when the door is open.

The cushion or bumper 230 is made of Neoprene 50 Durometer synthetic rubber. Because of the resilience of the material, it tends to move the door 10 and the hinge strap 202 toward the relationship illustrated in FIG. 10. This tends to urge the door 10 into the relative position as illustrated in FIG. 10, in which the door will be more readily received in proper alignment into the door casing 22. As the door is then locked by means of the fingers, gears and handle described above, compressing the sealing members, the cushion or bumper 230 comes under somewhat increased compression, for example when the door is in the position illustrated in FIG. 7.

Accordingly, the hinge 12 provides an additional rotational degree of freedom of the door 10 about the pivot axis 208. This additional degree of rotational freedom facilitates the door settling evenly against the resilient sealing members extending about the periphery of the door. This feature tends to equalize distribution of the sealing force of the door periphery against the casing, via the sealing members, to provide a seal of uniform force, and thus a uniform seal, about the entire door periphery where it engages the casing.

While the invention has been described with some particularity, it is to be understood that those of ordinary skill in the relevant art can make certain additions or modification to, herein, without departures from the spirit or scope of the invention, as defined in the amended claims.

I claim:

1. Apparatus for selectively effecting closure of an opening defined by a casing, said apparatus comprising:

a) a door generally sized to provide closure for the opening when said door is engaged with said casing;

b) a plurality of hinges coupled between said casing and said door for mounting said door for pivotal motion about a pivot axis located proximate an edge of the opening;

c) a plurality of locking fingers adapted for engagement with said casing;

d) structure for mounting said fingers on said door, near the periphery of said door, for sliding movement parallel to a major surface of said door for extension and retraction of said fingers between a locking position, wherein said fingers protrude outwardly beyond the edge of said door, to an unlocking position wherein said fingers do not so protrude;

e) a drive shaft extending along locations proximate a plurality of said slidably mounted fingers;

f) apparatus for converting axial rotation of said drive shaft to sliding motion of said fingers;

g) a drive rod mounted on said door for linear axial motion in a direction substantially perpendicular to the axis of said drive shaft;

h) mechanism including rack and gear for converting said linear axial motion of said drive rod to rotational axial motion of said drive shaft;

i) a handle movably mounted on said door;

j) drive rod linkage mechanism for converting movement of said handle to linear axial motion of said drive rod.

2. The apparatus of claim 1, wherein:

said drive rod linkage mechanism comprises a rack and pinion apparatus.

3. The apparatus of claim 1, wherein:

said apparatus for converting rotational motion of said drive shaft to sliding motion of said fingers comprises a rack and pinion apparatus.

4. A door locking and sealing assembly supported on a door, said door defining longitudinal edges, and being pivotally supported on a surrounding door casing with a pivot axis defined proximate and parallel to a door edge, said assembly comprising:

a) a blocking member reciprocally mounted on the door for engagement with the casing, said blocking member sealing said door closed when said blocking member is so engaged;

b) a keeper member positioned for latching engagement with said blocking member when said blocking member is engaged with said casing;

c) a blocking member reciprocating mechanism including:

i) a handle mounted on said door and being rotatable between a door sealed position and a door unsealed position;

ii) a driving linkage coupled between said handle and said blocking member, said linkage comprising:

(1) a gear member engaged with the handle member for rotation therewith;

(2) a movable rack member having a drive portion in mating engagement with said gear;

(3) a drive rod coupled to said rack member;

(4) a drive shaft coupled to move said blocking member in response to rotation of said shaft, and (5) rack and gear apparatus coupled between said drive rod and said drive shaft.

5. The apparatus of claim 1 further comprising:

a resilient sealing member in a location such that said sealing member is confined between a portion of said door and a portion of said casing when said door is locked, said sealing member comprising an elastomeric material impregnated with a conductive material.

6. The apparatus of claim 5, wherein said conductive material comprises metal.

7. The apparatus of claim 6, wherein said conductive material comprises silver.

8. The apparatus of claim 6, wherein said sealing member comprises an O-ring.

* * * * *